US005153992A

United States Patent [19]

Brown et al.

[11] Patent Number: 5,153,992

[45] Date of Patent: Oct. 13, 1992

[54] SAFETY RAZORS

[75] Inventors: Frank E. Brown, Maidenhead; John Taylor, Early Reading; David J. Wilks, Reading, all of United Kingdom

[73] Assignee: The Gillette Company, Boston, Mass.

[21] Appl. No.: 659,428

[22] PCT Filed: Jul. 10, 1990

[86] PCT No.: PCT/US90/03863

§ 371 Date: May 16, 1991

§ 102(e) Date: May 16, 1991

[87] PCT Pub. No.: WO91/01204

PCT Pub. Date: Feb. 7, 1991

[30] Foreign Application Priority Data

Jul. 24, 1989 [GB] United Kingdom ..... 8916885

[51] Int. Cl.[5] ..... B26B 21/00

[52] U.S. Cl. ..... 30/49; 30/346.57

[58] Field of Search ..... 30/34.1, 47-50, 30/346.55, 346.57

[56] References Cited

U.S. PATENT DOCUMENTS 4,803,780 2/1989 Locke et al. ..... 30/34.1

*Primary Examiner*—Douglas D. Watts

[57] ABSTRACT

A safety razor in which the blade has a plurality of sharp-edged apertures for shaving and also a sharpened rectilinear edge for trimming. Provision is made for effecting displacement of the blade relative to the razor handle so that the trimming edge which is normally in an inoperative position can be moved into an operative position. The blade is held in an arched position so that the aforesaid movement is of a rocking nature.

7 Claims, 7 Drawing Sheets

SAFETY RAZORS

This invention relates to safety razors, more particularly in which a blade member is in the form of a foil having a plurality of sharp edged apertures distributed over its surface to constitute a plurality of discrete cutting edges. Such blade members are referred to in the following description as "perforated blades".

In accordance with the invention, there is provided a safety razor comprising a perforated blade mounted in a foil holder and having a sharpened, rectilinear trimming edge means.

Preferably, the said edge means is normally inaccessible for use but can be brought into operation by effecting displacement of at least a part of the foil holder relative to the razor handle.

The razor can accordingly operate normally as a perforated blade razor, typically being employed with a reciprocating, "scrubbing" action, but the sharpened edge means can be brought into use as required for trimming operations, such as the trimming of sideburns or moustaches.

Some forms of razor in accordance with the invention are described in detail below, by way of example, with reference to the accompanying drawings, in which.

Figure 9:
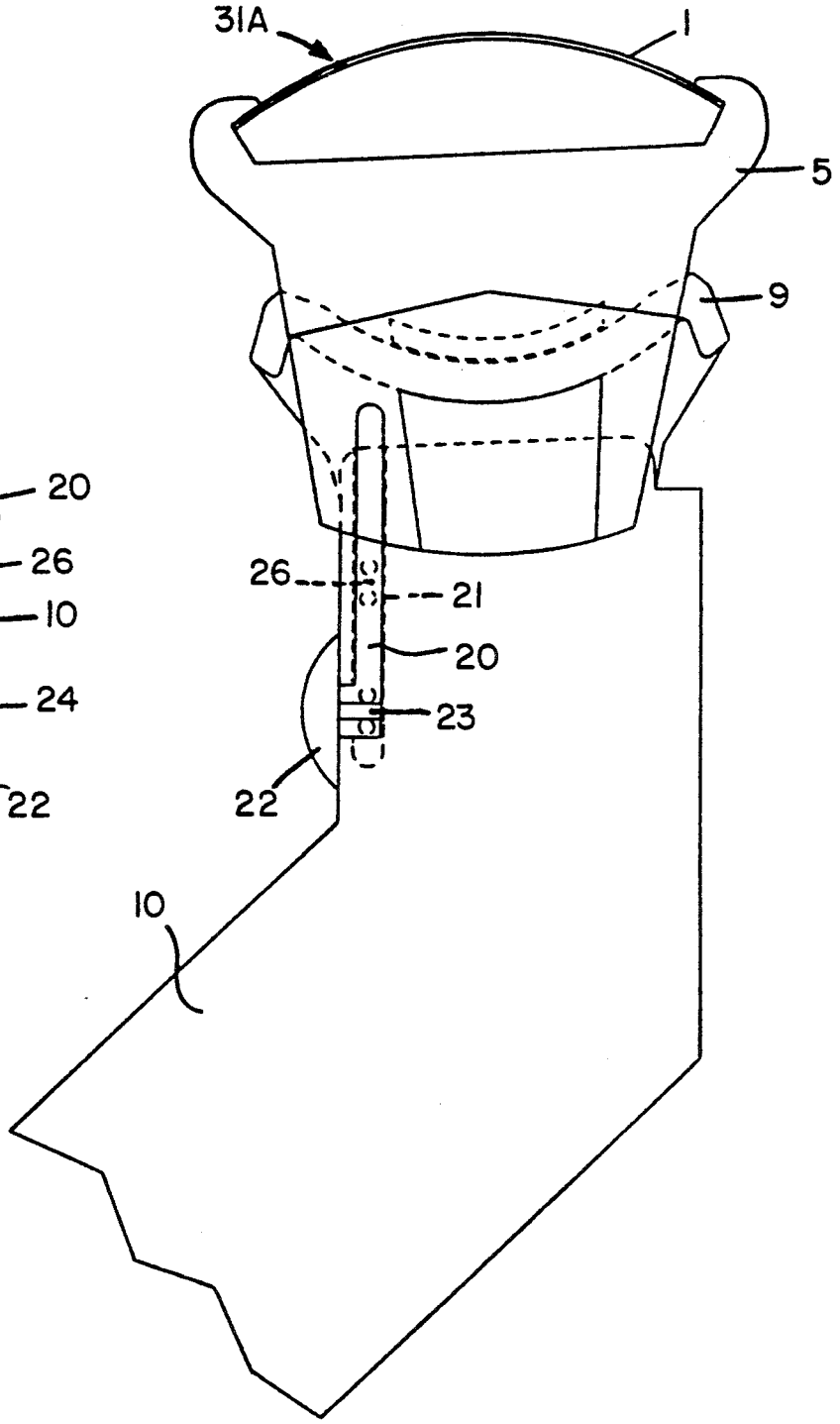
Figure 10:
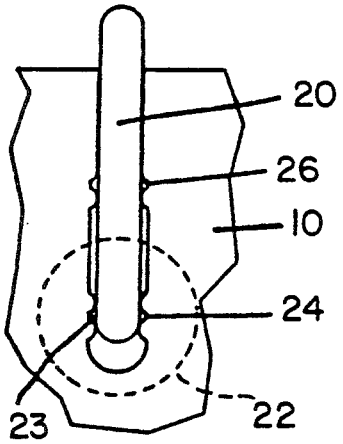
Figure 11:
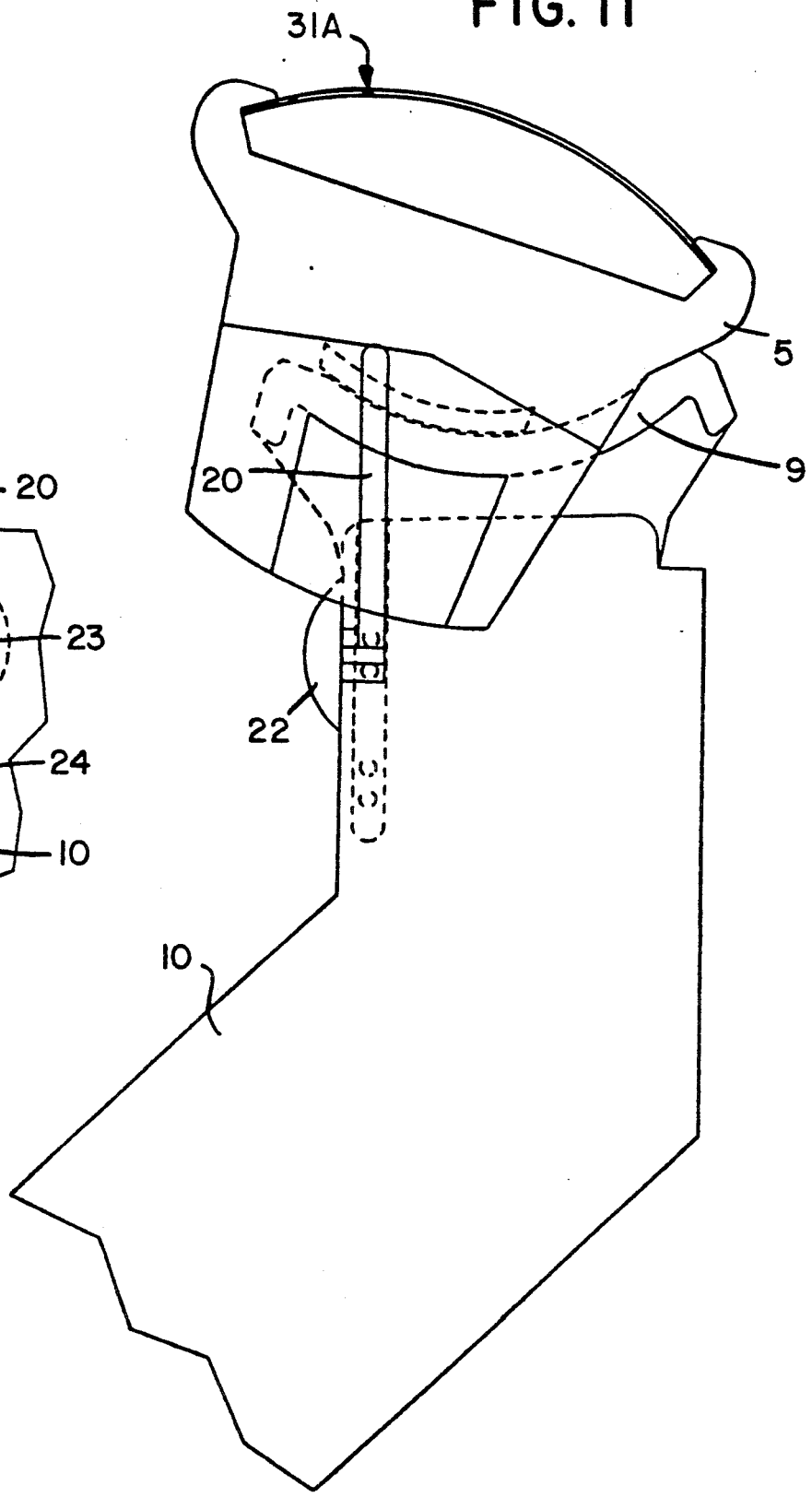
Figure 12:
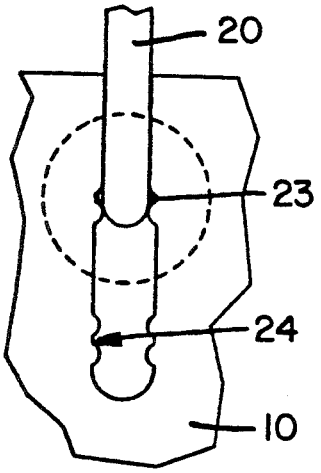

FIGS. 9 and 11 show a third form of a razor in its different operative positions; and FIGS. 10 and 12 are scrap views illustrating details of the razor of FIGS. 9 and 11.

The razor shown in the drawings comprises a perforated blade 1 in the form of a foil having sharp-edged apertures 2 distributed over its surface and having one longitudinal edge sharpened to form a trimming edge 3.

The blade is attached to a foil carrier 5 mounted in turn on a support 6 including a guard member 7 and depending lugs 8 by which the support 6 is mounted on cams 9 fast with the razor handle 10.

The support 6 is mounted on the handle in a manner which permits free, rocking movement of the support, relative to the handle, about an axis parallel with the trimming edge 3. This is conveniently provided by means of a pair of stationary, arcuate cams 9 fast with the handle, which engage in arcuate grooves in the lugs 8 of the support. The centre of curvature of the cams and grooves is disposed close to the surface of the foil, for example at the axis 'C' indicated in the drawings.

The carrier has a range of free, rocking movement during normal shaving to permit additional conformance of the foil to the skin contours. However, to expose the trimmer edge, the support must first be latched into its fixed position, shown in FIG. 4, at one end of its range of rocking movement. For this purpose, a latch projection 14 is formed on one or both lugs 8 for co-operation with an adjacent portion on the cam 9. As best seen in FIG. 4A, the latch projection 14 takes the form of a triangular fillet which presents a stop to free rocking movement of the support in normal use of the razor. However, the user can apply some manual effort to force the cam to spring past the projection 14 into the position shown in FIG. 4.

The support 6 includes a platform section 11 fast with the remainder of the support and onto which the foil carrier is clipped in a bi-stable manner. In the "normal" and "fixed" positions shown in FIGS. 3 and 4, the platform 11 is fully engaged in a channel formed in the underside of the foil carrier. However, due to the resilience of the parts, the carrier can be displaced angularly relative to the support, to the position shown in FIG. 5, in which the forward (left-hand) edge of platform section 11 has snapped past a detent projection 13 formed on the foil carrier. This exposes the sharpened edge for trimming, with the foil carrier and support in fixed position.

Figure 1:
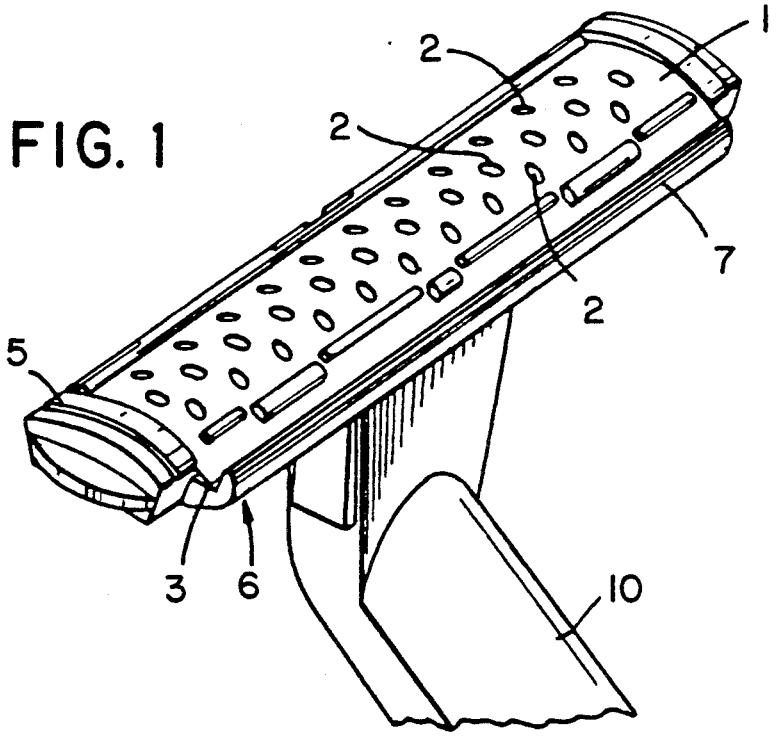
FIGS. 1 and 2 are perspective views of a razor with its parts adjusted into a shaving mode and a trimming mode, respectively.
Figure 2:
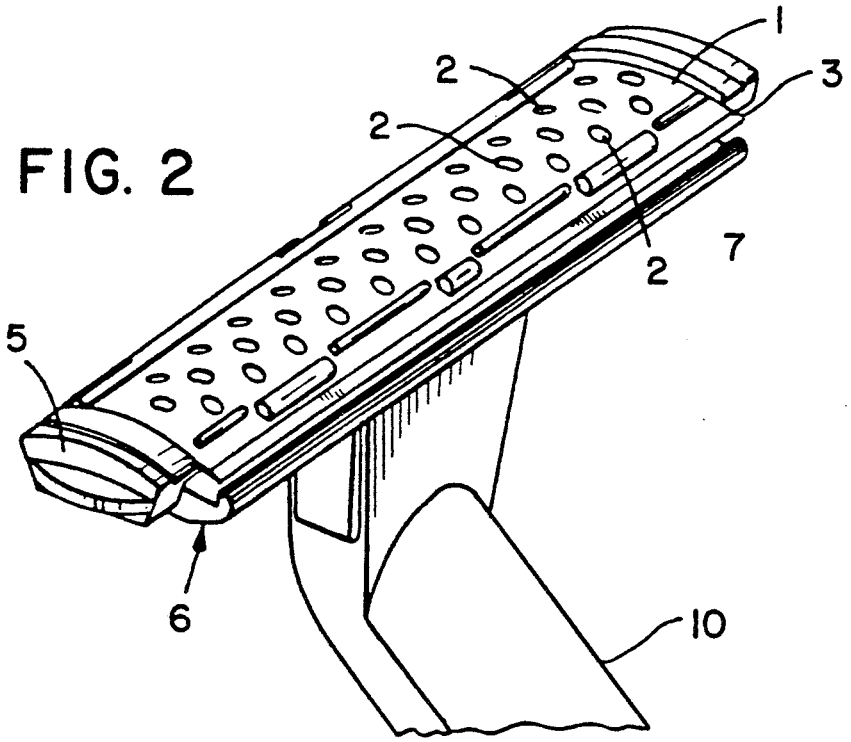
Figure 3:
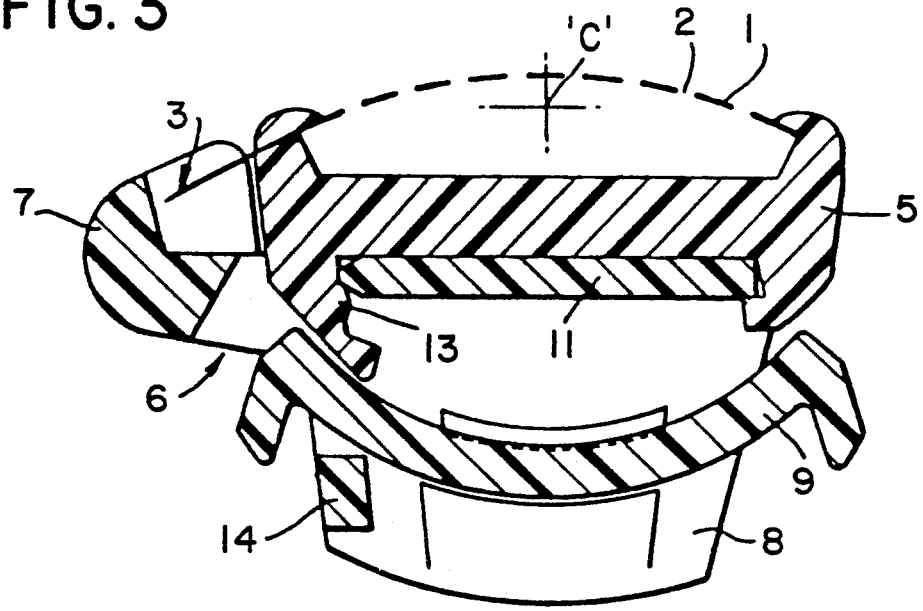
FIGS. 3, 4 and 5 are sectional views showing the razor parts in a normal shaving mode, a fixed position and the trimming mode, respectively.
Figure 4:
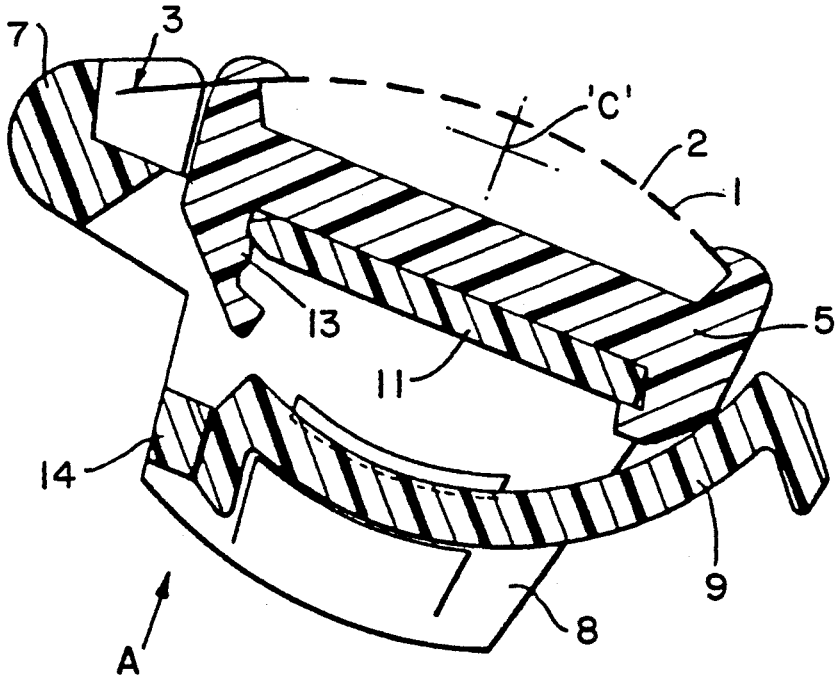
Figure 4A:
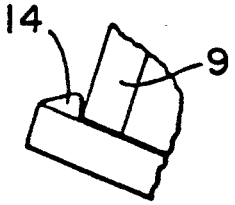
FIG. 4A is a scrap detail view taken in the direction of arrow 'A' in FIG. 4.
Figure 5:
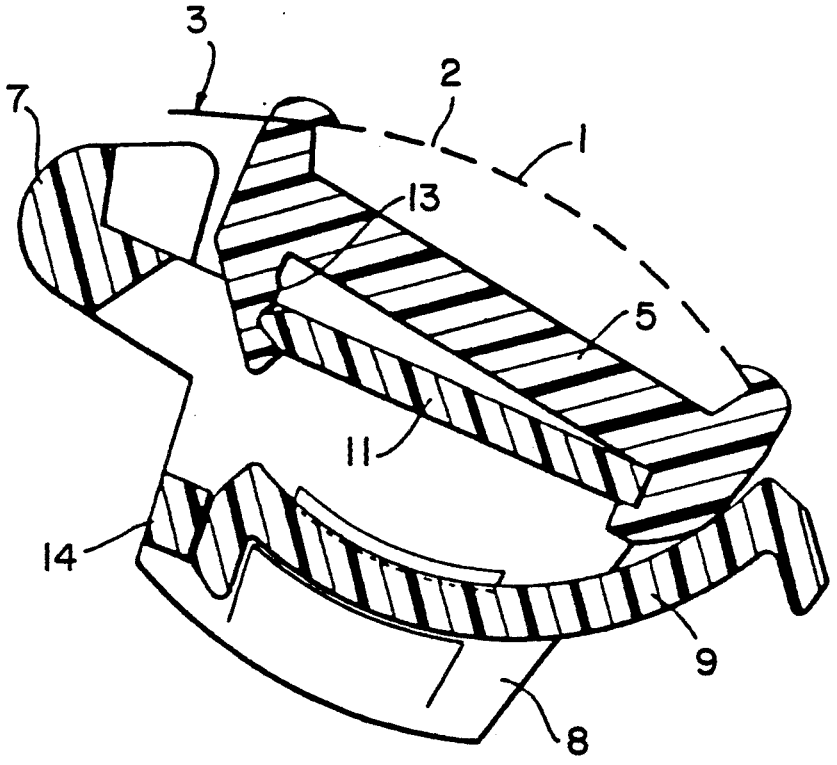

To summarise: the razor is normally in the condition illustrated in FIGS. 1 and 3, in which the edge 3 is safely obscured and the support 6 and foil carrier 5 can rock as one about the axis C relative to the handle;

by deliberate manual displacement applied through the carrier 5, the carrier and support can be moved into the position shown in FIG. 4, in which the edge 3 is still concealed but the support is held stationary on the handle;

further manual effort applied in the same direction causes the carrier 5 to spring into the position illustrated in FIGS. 2 and 5, exposing the edge 3 for use;

reversal of the above procedure will first restore the carrier 5 to its normal position relative to the support and guard, and then release the support for rocking movement about the axis C.

It will be noted that the latch projection 14 is asymmetrical in its form so as to present less resistance to movement of the support into the extreme position of FIG. 4 than in the reverse direction. Also, it is designed to present less resistance to relative motion than the catch projection 13 in one direction than in the other, so that a smaller effort is required to return the carrier to its normal position than to return the support to its normal position.

Although movement of the parts into the position shown in FIG. 4 is primarily intended as a prelude to exposing the trimming edge, the razor is perfectly operable as a "fixed head" razor in that condition.

The above described razor may be designed as a disposable razor, in which case the support 6 is permanently associated with the handle. Alternatively, the support may be releasably mounted on the handle cams, or the foil carrier (and foil) may be releasably mounted on the support so that the foil and foil carrier, with or without the support, can form exchangeable blade cartridges.

Figure 6:
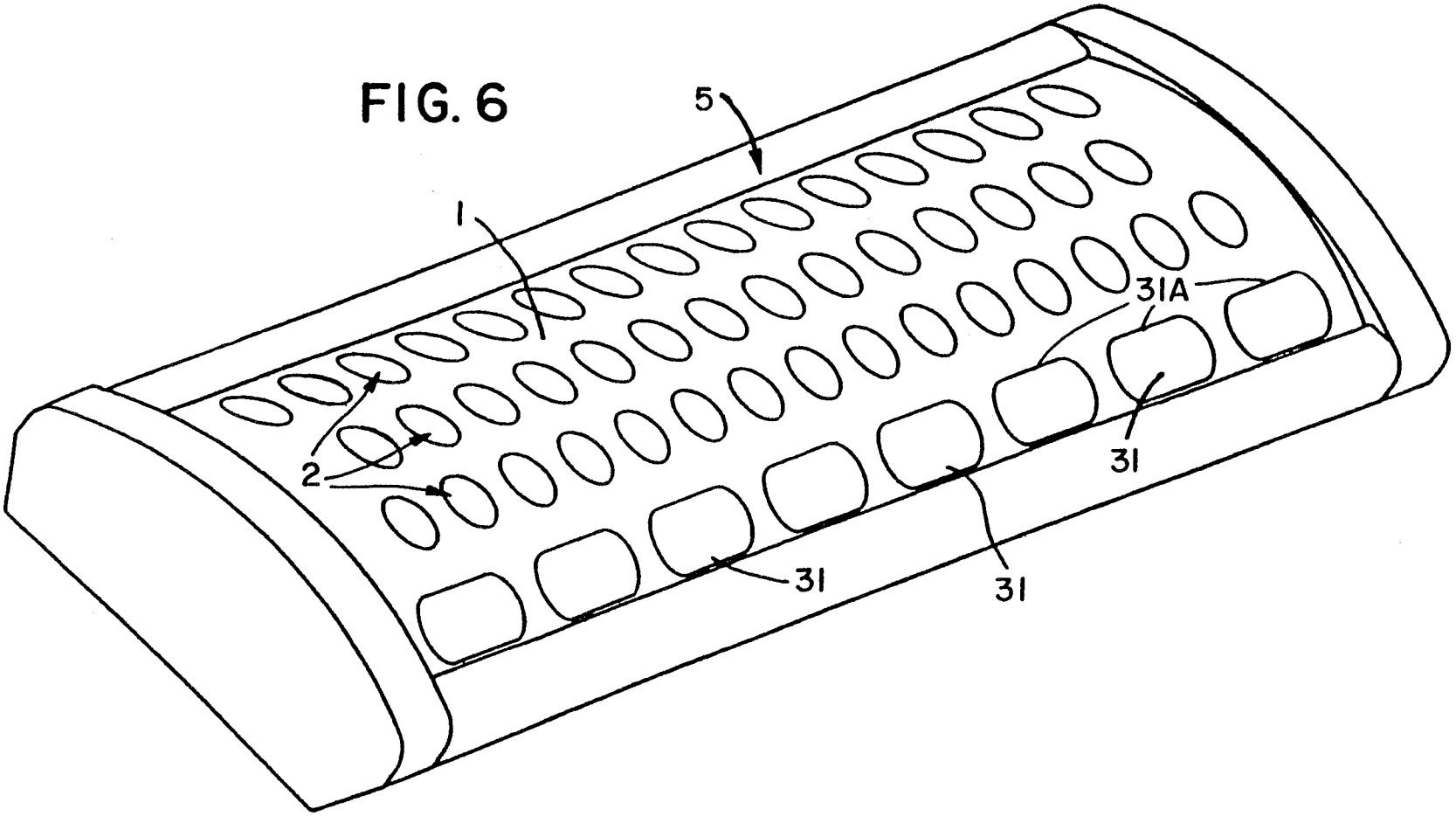
FIG. 6 is a perspective view of the head of a second form of razor.
Figure 7:
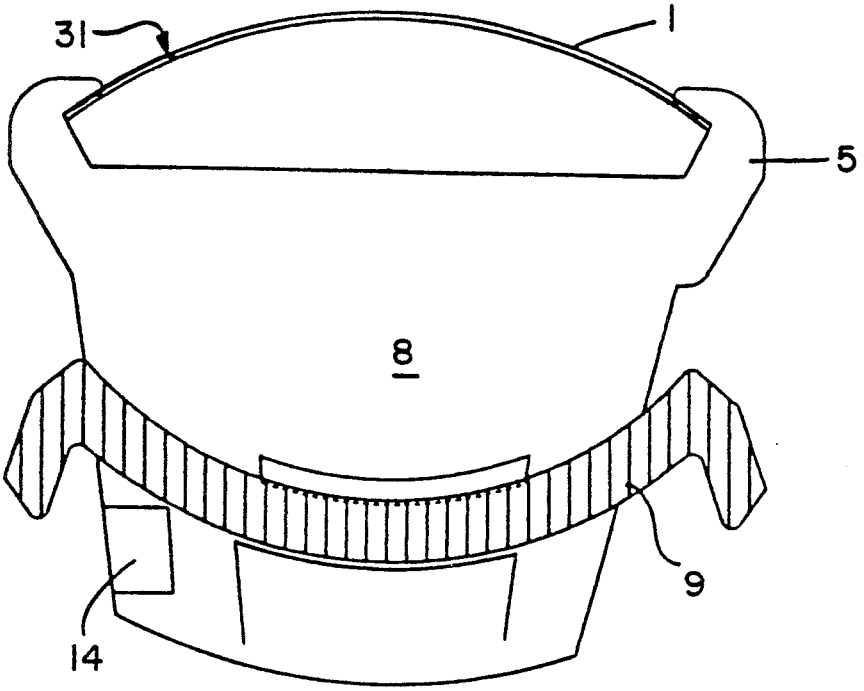
FIGS. 7 and 8 are sectional views showing parts of the second razor in its normal and trimming positions, respectively.
Figure 8:
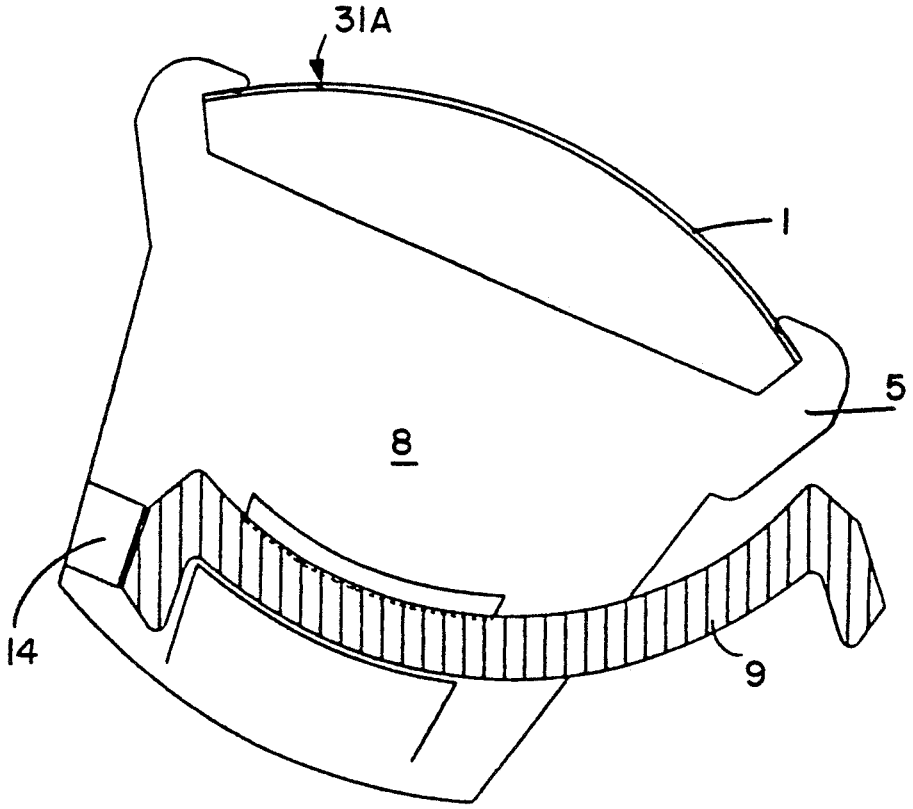

In the embodiment illustrated in FIGS. 6, 7 and 8, the perforated blade 1 has, in addition to the apertures 2 provided for normal shaving, a row of elongated apertures 31 positioned adjacent one edge of the foil. The inner edges of these apertures are sharpened to form a series of aligned, rectilinear trimming edges 31A.

In this razor, there is no movable guard to conceal the trimming edges in normal use of the razor. Instead, they are simply positioned so as to be held clear of the skin in the normal range of attitudes of the blade relative to the handle.

The foil holder 5 is again supported on the cam 9 so as to have a range of rocking movement in normal use of the razor, to either side of the medial position shown in FIG. 7. When it is desired to bring the trimming edges into play, the foil holder is rocked in a clockwise sense, as viewed in FIG. 7, to force the cam to spring past the latch projection 14, to lock the foil holder 5 in the position shown in FIG. 8, in which the trimming edges 31A are positioned "high up" at the leading side of the blade foil.

The razor shown in FIGS. 9 and 10 is generally similar to that of FIGS. 6 to 8 except for the means of latching the foil holder in the trimming position. In this embodiment, the handle is fitted with a manually actuated sliding latch comprising rod 20 slidably mounted in a slot 21 in the handle and an external operating button 22. The rod has a pair of rounded ribs 23 at its lower end and the sides of the slots are formed with upper and lower pairs of recesses 24, 26 for co-operation with the ribs.

The latch is shown in FIG. 9 in its lower, retracted position, where it is held by engagement of the ribs 23 in the lower pair of recesses 24, and in which the foil holder 5 is free to rock for normal shaving. For trimming operation, the latch is pushed to its upper, extended position. The upper end of the rod engages the underside of the foil holder 5 and rocks the holder clockwise to its extreme position, as shown in FIG. 11. The parts are all held in this position by engagement of the ribs 23 in the upper pair of recesses 26, as shown in FIG. 12.

Upon manual return of the latch to its lower position, the foil holder is again free to rock.

We claim:

1. A safety razor comprising a perforated blade (1) having a plurality of sharp edged apertures (2) distributed over its surface, the said blade (1) being mounted in a foil carrier (5), characterized in that the razor further comprises sharpened, straight continuous trimming edge means (3, 31A); and, wherein said edge means is formed on the perimeter of said blade (1).

2. A Safety Razor comprising a perforated blade (1) having a plurality of sharp edged apertures (2) mounted in a foil carrier (5), characterized in that the razor further comprises sharpened, straight trimming edge means (3, 31A; and wherein said edge means is formed on the perimeter of said blade (1)

a support (6) on which said foil carrier (5) is mounted;

said foil carrier (5) operably displaceable with respect to said support (6);

whereby, said edge means (3, 31A) is normally inaccessible for use and is selectively brought into orientation by displacement of the foil carrier (5) relative to said support (6).

3. A safety razor according to claim 2, characterized in that the foil carrier (5) is mounted on a support (6) the said support including a guard member (7) which normally obscures the edge means (3), and that the carrier (5) is disposable, relative to the support (6) to expose the edge means (3).

4. A safety razor according to claim 3, characterized in that the carrier (5) is connected to the support (6) in a bi-stable manner to occupy either of two operative positions, means being provided for resiliently detaining the carrier (5) in each position relative to the support (6).

5. A safety razor according to claim 3, characterized in that the blade (1) is held in an arched condition in the carrier (5) and that the support (6) is mounted on the handle (7) for rocking movement about a horizontal axis (C) parallel with the axis of curvature of the blade (1) and that indexing means (14) are provided for selectively retaining the support (6) at an extreme position in its range of rocking movement.

6. A safety razor according to claim 2, characterized in that the said foil carrier (5) is mounted on the handle for movement between a position of normal use in which the edge means is substantially inaccessible for use, and an extreme position in which the edge means is presented in a position of use.

7. A safety razor according to claim 6, characterized in that the foil carrier (5) supports the blade member (1) in an arched condition and is mounted on the handle for rocking movement about an axis parallel with the axis of curvature of the blade (1), the carrier being displaceable into an extreme position in which it is held against rocking movement and in which the edge means (31A) is presented for use.

* * * * *